US005429233A

United States Patent [19]

Juaristi

[11] Patent Number: 5,429,233

[45] Date of Patent: Jul. 4, 1995

[54] DISPLAY PACKAGE FOR ELECTRIC BATTERIES

[75] Inventor: Ignacio S. Juaristi, Vitoria, Spain

[73] Assignee: Celaya, Emparanza y Galdos, S.A. (Cegasa), Spain

[21] Appl. No.: 233,363

[22] Filed: Apr. 25, 1994

[30] Foreign Application Priority Data

Apr. 28, 1993 [ES] Spain ..... 9301152

[51] Int. Cl.[6] ..... B65D 73/02

[52] U.S. Cl. ..... 206/705; 206/461; 206/45.31

[58] Field of Search ..... 206/45.31, 333, 461, 206/464, 465, 471

[56] References Cited

U.S. PATENT DOCUMENTS

| | | | |
|---|---|---|---|
| 1,711,877 | 5/1929 | Drehmann | 206/464 |
| 3,869,043 | 3/1975 | Warner et al. | 206/464 |
| 4,508,225 | 4/1985 | Ferrari | 206/461 |
| 4,723,656 | 2/1988 | Kiernan et al. | 206/333 |
| 4,958,731 | 9/1990 | Calcerano | 206/333 |
| 5,251,756 | 10/1993 | Grange | 206/461 |

FOREIGN PATENT DOCUMENTS

| | | | |
|---|---|---|---|
| 2578515 | 9/1986 | France | 206/333 |
| 9201071 | 5/1992 | Spain . | |

*Primary Examiner*—David T. Fidei
*Attorney, Agent, or Firm*—Lucas & Just

[57] ABSTRACT

Display package for electric batteries, constituted by the glued assembly of two parts of recyclable cardboard sheet, comprising, as a first part, a supporting plate (1) provided with a suitable eyelet (6) for being hung up, and as a second part a parallelepipedal receptacle (2) containing the batteries (7) and glued to the front, the lateral vertical walls (2b) of said parallelepipedal receptacle (2) each forming at their lower ends vertical prolongations (3) which extend until reaching the lower edge (1c) of the supporting plate (1) with which they cooperate in forming a base that is orthogonal to the supporting plate (1) and which makes it possible for the package to be self-supporting in the vertical position.

2 Claims, 1 Drawing Sheet

DISPLAY PACKAGE FOR ELECTRIC BATTERIES

FIELD OF THE INVENTION

The use of display packages which can be displayed—hung from a support designed for that purpose or supported in an upright position on a rack—and which are known all over the world as "blister" packages, an English term meaning "bubble" since these packages have an internal receptacle visually accessible from the exterior and which is similar to a bubble shaped to fit the contour of the unit or group of units of the article accommodated within it, in the present case electric batteries, is common particularly for electric batteries, but also for other articles.

PRIOR ART

In its classical and traditional structure the blister bubble is made of polyvinyl chloride (PVC) and is joined to a supporting plate made of cardboard by heat sealing, said plate being provided with means for hanging.

In the light of current budgets and of actions taken to preserve an uncontaminated atmosphere, this structure presents the serious problem that the decomposition of PVC produces the highly noxious gas chlorine ($Cl_2$), and this decomposition of the PVC will take place sooner or later either as a result of voluntary incineration of already used-up blisters or by uncontrolled incineration produced by the heat generated in waste dumps as a result of the natural process of decomposition of organic substances.

Furthermore, in view of the recycling of used materials, the fact that the blister is composed of two parts consisting of materials of different nature makes it necessary to first separate the two different components and channel them toward their specific industrial recovery processes, which is a problem aggravated by the fact that, because of the heat seal, the PVC carries adherent cardboard residues of the supporting plate.

The problem of $Cl_2$ emissions to the atmosphere has been solved by replacing the PVC of the bubble with other plastics devoid of the chlorine constituent, such as polyethylene terephthalate (PET). Nevertheless, this only constitutes a partial solution of the problem, since the fact remains that the blister consists of two components which must be recycled separately.

This problem is in the process of being completely solved by the content of Spanish Patent No. 9201071, whose owner is the same as the applicant for the present Utility Model, which patent claimed the constitution of a blister-type package wherein the transparent bubble, until then made of a plastic (PVC or PET), was replaced by a parallelopipedal receptacle also made of cardboard, like the supporting plate, in such a way that the new blister was put together by combining (by gluing) two pieces of cardboard, a measure which, at one go, solved the problem of contaminant $Cl_2$ emissions and made possible the complete recycling of the package by means of a single industrial process, without the necessity of separating different components. Obviously, said two pieces of combined cardboard consist in the flat supporting plate and a parallelepipedal receptacle which can be glued in front of or behind said supporting plate; when the receptacle is applied behind it, the supporting plate will have a display window and the receptacle may be enclosed or have perforations for visual access; when the receptacle is applied in front, said display window will be created in the front of said receptacle; in beth cases the receptacle is obtained by folding a flat stamped cutout of sheet of cardboard, a folding which, once done, perimetrally provides some outwardly turned flaps, with the aid of which the gluing to the supporting plate will be accomplished.

EXPLANATION OF THE INVENTION AND ADVANTAGES

The present invention relates to some improvements applicable to the contents protected by said Spanish Patent No. 9201071, particularly with regard to the parallelepipedal receptacle provided with a display window and applied to the anterior or principal surface of the flat and continuous supporting plate, which has an eyelet for being hung from the display support and which is the substrate for appropriate ornamental inscriptions and legends relating to the characteristics and use of the packaged product.

A first improvement according to the invention consists in that, in relation to the vertical position of conventional display of the package, the vertical side walls in said parallelepipedal receptacle form, at their respective lower ends, vertical prolongations which also involve the corresponding flap designed for being glued to the supporting plate, and which extend Just until reaching the lower edge of said supporting plate with which they cooperate in defining a single base plate orthogonal to said supporting plate.

As a result of this improvement the package is provided with a lower horizontal base which enables it to be self-supporting in an upright position on a rack, as an alternative to being hung from a display support by means of the stamped eyelet which is conventionally provided in the upper part of the supporting plate.

Another improvement in accordance with the invention consists in that said display window not only involves the front of said parallelepipedal receptacle, but also extends collaterally until its vertical sides are situated on said lateral walls of said parallelepipedal receptacle.

This second improvement considerably widens the angle of visualization of the batteries contained in the package, without lessening its structural stability, which becomes highly advantageous from the esthetic and commercial points of view.

These aforementioned characteristics can be clearly inferred from the preferred embodiment illustrated in the attached drawings.

DRAWINGS AND REFERENCE NUMERALS

To better understand the nature of the present invention, there is shown in the attached drawings a preferred form of industrial execution of said invention, which is presented as a merely illustrative and nonlimitative example.

Figure 1:
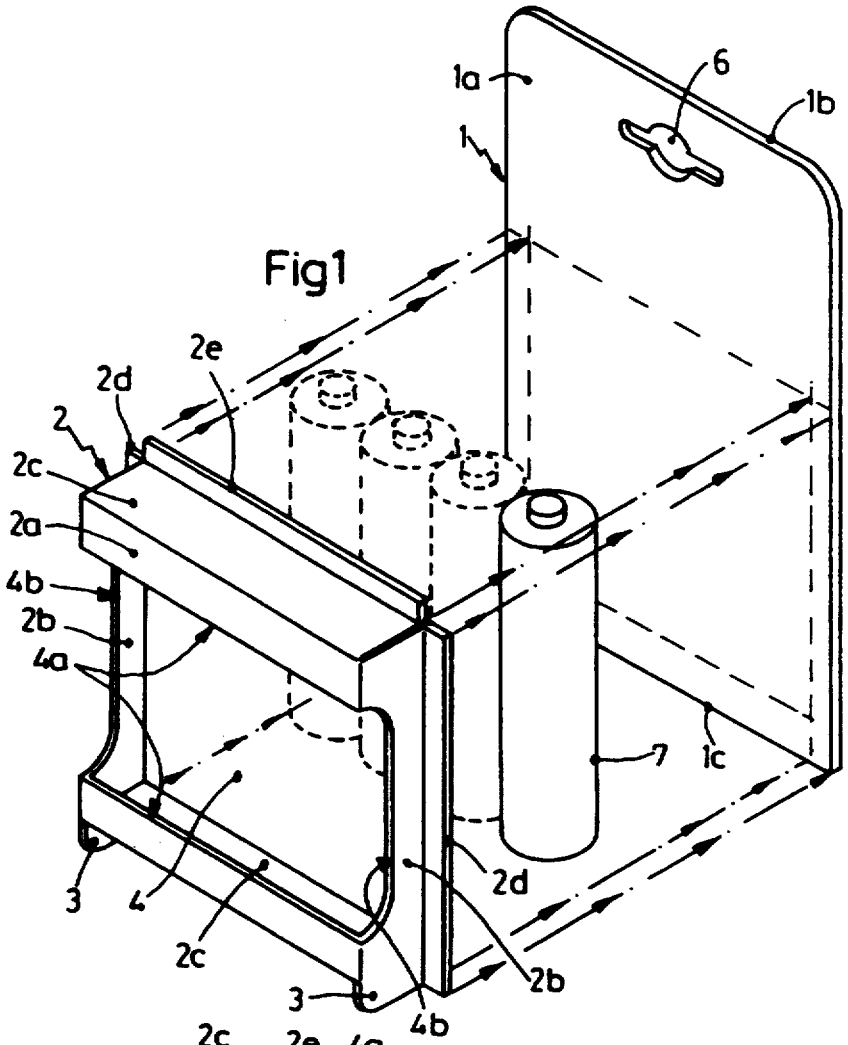
FIG. 1 is a perspective view of the structure of the blister package in question, showing separately and in their relative position of assembly the parallelepipedal receptacle (2) and the supporting plate (1), with the batteries (7) interposed between the two.

Indicated in these figures are the following reference numerals:

1—Supporting plate

1*a*—Anterior or principal face of the supporting plate (1)

1*b*—Posterior face of the supporting plate (1)

1*c*—Lower edge of the supporting plate (1)

2—Parallelepipedal receptacle

2*a*—Front of the receptacle (2)

2*b*—Lateral vertical walls of the receptacle (2)

2*c*—Lateral horizontal walls of the receptacle (2)

2*d*—Gluing flaps of the walls (2*b*)

2*e*—Gluing flaps of the walls (2*c*)

3—Lower prolongation of the walls (2*b*)

4—Display window of the receptacle (2)

4*a*—Horizontal sides of the window (4)

4*b*—Vertical sides of the window (4)

5—Stamped flat cutout of cardboard sheet

6—Hole or eyelet in the supporting plate (1) for hanging

7—Batteries

DESCRIPTION OF A PREFERRED EMBODIMENT

Referring to the above-mentioned drawings and reference numerals, the attached plan shows a preferred embodiment of a blister package which incorporates the improvements proposed in the present invention.

Figure 2:
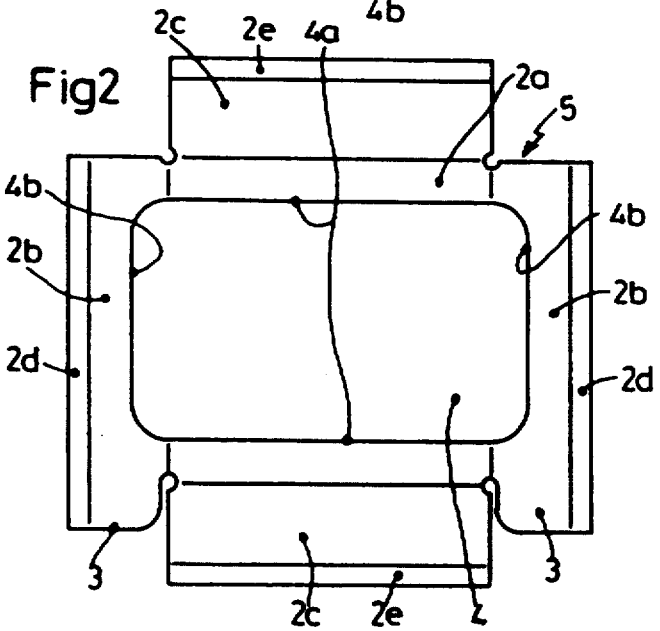
FIG. 2 is a view in orthogonal projection which shows, in plan, the stamped flat cutout (5) before it is folded to make up the receptacle (2).
Figure 3:
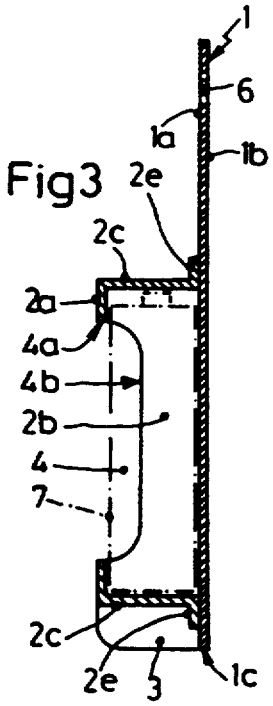
FIG. 3 shows the final and operative structure of the blister package in sectional view taken along the median vertical plane at right angle to the supporting plate (1).

These improvements relate to a version of blister package protected by the subject of the aforementioned Spanish Patent No. 9201071, particularly by that version in which the supporting plate (1) made of cardboard is blind except for the eyelet for hanging up (6), and that the parallelepipedal receptacle (2) is glued to the anterior face (1*a*) of said supporting plate (1) and is made up by folding the stamped flat cutout (5) also consisting of cardboard and shown in FIG. 2, and which receptacle, in essence, is constituted of a front (2*a*) provided with the corresponding display window (4) and of respective pairs of vertical (2*b*) and horizontal (2*c*) walls each provided with flaps (2*d*) and (2*e*) for gluing onto said base plate (1), the internal dimensions between said four walls (2*b*, 2*c*) being adjusted for the accommodation of the article to be packaged, in this case of four cylindrical batteries (7).

In these figures the special improvements now proposed can clearly be seen, namely, on the one hand, the prolongations (3) which involve the lower edge of beth the lateral walls (2*b*) and the corresponding flaps for gluing (2*d*) and whose longitudinal vertical extension shall be such as to define, together with the lower edge (1*c*) of the supporting plate (1), a plane perpendicular to said supporting plate (1), which will depend on the specified height at which said receptacle (2) is to adhere to said supporting plate (1); as was already explained, said generated perpendicular plane provides a broad base which makes it possible to stabilize the upright position of the package on a rack, as a form of display alternative to being hung from said eyelet (6); and on the other hand the fact that the display window (4) extends beyond the lateral limits imposed by said front (2*a*) to locate its vertical sides (4*b*) within the lateral walls (2*b*), whereby the batteries (7) packaged in its interior become more visible.

What is claimed is:

1. A display package for electric batteries constituted by a glued assembly of two cardboard sheets, one said cardboard sheet being a supporting plate having an eyelet operative to permit it to be hung from a support, the other said cardboard sheet comprising a folded stamped cardboard sheet glued to the anterior face of said one said cardboard sheet, said two cardboard sheets forming a parallelepipedal structure when glued together, said other cardboard sheet comprising lateral, parallel vertical walls, said vertical wall being foldably affixed to flaps which are glued to the said anterior face of said one said cardboard sheet, extensions on said lateral, parallel vertical walls and extensions on said flaps, all said extensions extending to the lower edge of said supporting plate, said extensions on said lateral, parallel vertical walls forming a base orthogonal to said supporting plate and said extensions on said flaps strengthening the extensions on said lateral, parallel vertical walls, said other said cardboard sheet including a cut-out window between said lateral, parallel vertical walls, whereby electric batteries contained in said parallelepipedal structure can be viewed through said window by a potential purchaser.

2. The display package of claim 1 wherein said cut-out window extends into said lateral, parallel vertical walls.

* * * * *